US011253023B2

(12) United States Patent
Hatfield et al.

(10) Patent No.: US 11,253,023 B2
(45) **Date of Patent: *Feb. 22, 2022**

(54) UPPER COMPONENT FOR AN ARTICLE OF FOOTWEAR

(71) Applicant: NIKE, Inc., Beaverton, OR (US)

(72) Inventors: Tobie D. Hatfield, Lake Oswego, OR (US); Ami Davis, Hillsboro, OR (US); John T. Dimoff, Portland, OR (US); Nadia M. Panian, Beaverton, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 150 days.

This patent is subject to a terminal disclaimer.

(21) Appl. No.: 16/738,256

(22) Filed: Jan. 9, 2020

(65) Prior Publication Data

US 2020/0146391 A1 May 14, 2020

Related U.S. Application Data

(63) Continuation of application No. 15/793,346, filed on Oct. 25, 2017, now Pat. No. 10,568,382.

(Continued)

(51) Int. Cl.

*A43B 11/00* (2006.01)
*A43B 11/02* (2006.01)

(Continued)

(52) U.S. Cl.

CPC ..... *A43B 11/00* (2013.01); *A43B 11/02* (2013.01); *A43B 3/0005* (2013.01);

(Continued)

(58) Field of Classification Search

CPC ..... A43B 11/00; A43B 11/02; A43C 11/165

See application file for complete search history.

(56) References Cited

U.S. PATENT DOCUMENTS 4,154,009 A * 5/1979 Kubelka ..... A43C 11/002 36/117.6
7,168,190 B1 * 1/2007 Gillespie ..... A43B 3/24 36/102

(Continued)

FOREIGN PATENT DOCUMENTS

CN 2819852 Y 9/2006
CN 203040833 U 7/2013

(Continued)

*Primary Examiner* — Ted Kavanaugh

(74) *Attorney, Agent, or Firm* — Quinn IP Law

(57) ABSTRACT

An upper component for an article of footwear allows easy entry of the foot into the article of footwear. The upper component includes a heel body, which includes a first portion partially defining an ankle opening. The heel body further includes a second portion coupled to the first portion. The second portion is foldable and partially defines the ankle opening. The second portion is movable relative to the first portion between an unfolded configuration and a folded configuration. The upper component includes at least one tension member coupled to the second portion. The tension member is movable relative to the first portion to move the second portion from the unfolded configuration to the folded configuration. The ankle opening is larger when the second portion is in the unfolded configuration than when the second portion is in the folded configuration.

20 Claims, 8 Drawing Sheets

Related U.S. Application Data

(60) Provisional application No. 62/413,185, filed on Oct. 26, 2016.

(51) Int. Cl.
*A43C 11/16* (2006.01)
*A43B 3/00* (2022.01)
*A43B 23/02* (2006.01)

(52) U.S. Cl.
CPC ..... *A43B 23/0205* (2013.01); *A43B 23/0245* (2013.01); *A43C 11/165* (2013.01)

(56) References Cited

U.S. PATENT DOCUMENTS 7,793,438 B1 * 9/2010 Busse ..... A43B 11/02 36/105
9,949,533 B2 * 4/2018 Feinstein ..... A43B 23/0215
10,568,382 B2 * 2/2020 Hatfield ..... A43B 11/02
2008/0307673 A1 * 12/2008 Johnson ..... A43C 11/14 36/50.1
2010/0319216 A1 * 12/2010 Grenzke ..... A43C 1/00 36/54
2011/0214312 A1 * 9/2011 Krikelis ..... A43B 3/00 36/102
2012/0291242 A1 11/2012 Donnadieu
2017/0150773 A1 * 6/2017 Beers ..... A43B 3/001
2017/0265560 A1 * 9/2017 Beers ..... A43C 11/165
2019/0000186 A1 * 1/2019 Mou ..... F04B 45/047

FOREIGN PATENT DOCUMENTS

CN 104822284 A 8/2015
CN 105263350 A 1/2016
CN 105722419 A 6/2016
JP S11001710 Y 2/1936
JP S54166795 U 11/1979
JP H0720812 U 4/1995
JP 2016500299 A 1/2016
WO 2009071652 A1 6/2009

* cited by examiner

UPPER COMPONENT FOR AN ARTICLE OF FOOTWEAR

CROSS-REFERENCE TO RELATED APPLICATION

The present disclosure is a continuation of U.S. patent application Ser. No. 15/793,346, filed on Oct. 25, 2017, which claims priority to, and the benefit of U.S. Provisional Patent Application No. 62/413,185, filed on Oct. 26, 2016, each of which is incorporated by reference in its entirety.

TECHNICAL FIELD

The present teachings generally relate to an upper component for an article of footwear. More specifically, the present teachings relate to an upper component including a foldable portion.

BACKGROUND

Traditionally, placing footwear on a foot often requires the use of one of both hands to stretch the ankle opening of a footwear upper, and hold the second portion during foot insertion, especially in the case of a relatively soft upper and/or an upper that does not have a heel counter secured to a flexible fabric rearward of the ankle opening.

DETAILED DESCRIPTION

Figure 1:
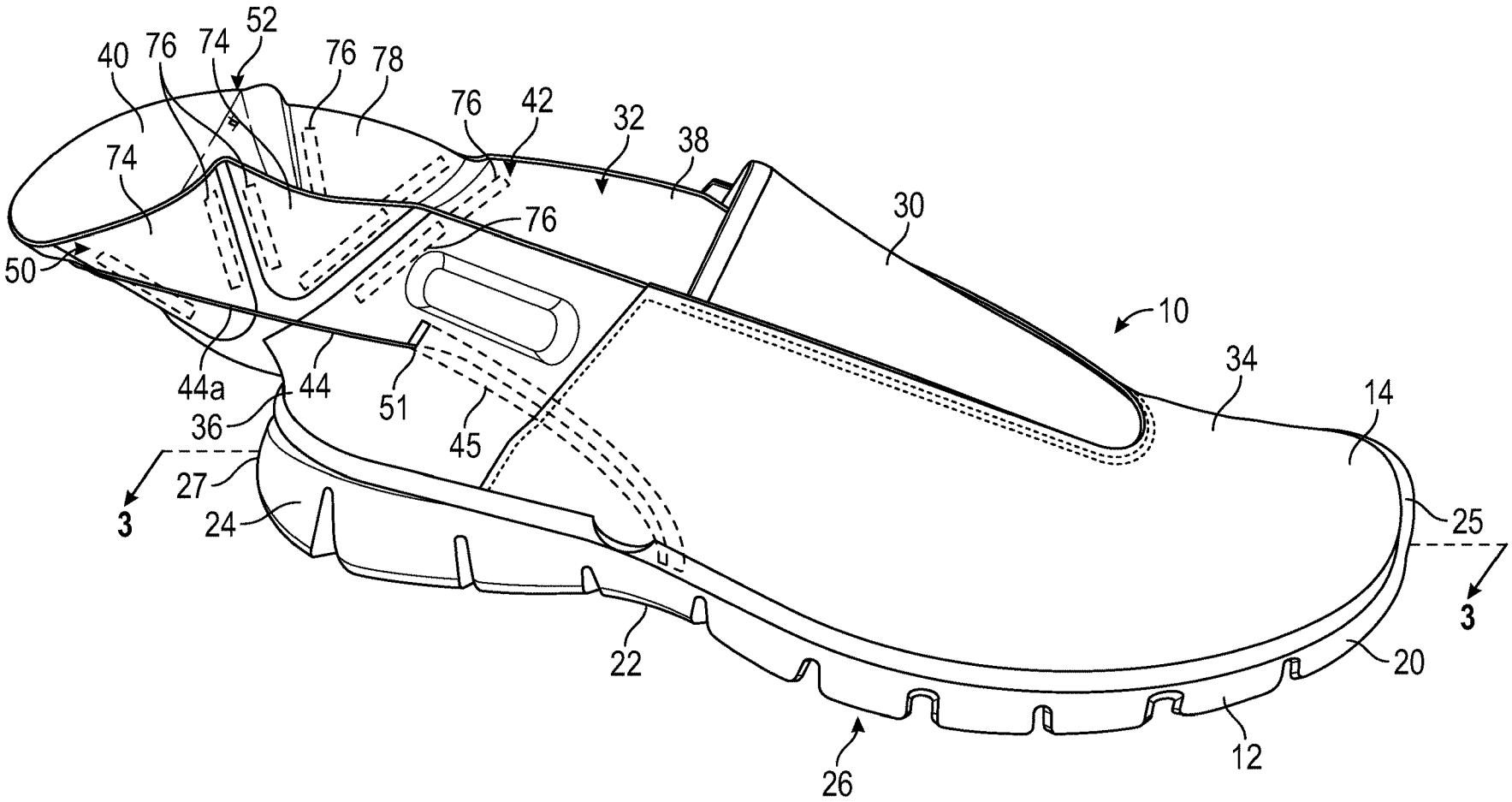
FIG. 1 is a schematic illustration in lateral perspective view of an article of footwear for a wearer's right foot including an upper component and a sole structure coupled to the upper component, wherein the upper component includes a heel body including a first portion and a second portion, and the second portion is foldable and shown in an unfolded configuration.

The present disclosure describes an upper component for an article of footwear that allows easy entry of the foot into the article of footwear. The upper component includes a heel body. In one or more embodiments, the heel body includes a first portion partially defining an ankle opening. The heel body further includes a second portion coupled to the first portion. The second portion is foldable and partially defines the ankle opening. Further, the second portion is movable relative to the first portion between an unfolded configuration and a folded configuration. The upper component further includes at least one tension member coupled to the second portion. The tension member is movable relative to the first portion to move the second portion from the unfolded configuration to the folded configuration. The ankle opening is larger when the second portion is in the unfolded configuration than when the second portion is in the folded configuration to allow easy entry of the foot into the article of footwear.

In one or more embodiments, the upper component may further include a tube partly disposed inside the first portion. The tension member is disposed in the tube to minimize friction between the at least one tension member and the heel body when the tension member moves relative to the first portion.

In one or more embodiments, the second portion may include a medial foldable side and a lateral foldable side. The tension member may include a first string segment coupled to the second portion at the foldable lateral side. The tension member may include a second string segment coupled to the second portion at the foldable medial side. The tension member may include a third string segment interconnecting the first string segment and the second string segment. The third string segment may be disposed outside the heel body to allow a wearer to manually pull the third string segment to move the second portion from the unfolded configuration to the folded configuration.

In one or more embodiments, the upper component can be combined with a sole structure. The sole structure may include a spool assembly coupled to the sole structure. The spool assembly may be coupled to the tension member to move the second portion between the unfolded configuration and the folded configuration.

In one or more embodiments, the sole structure may include a sole forefoot portion, a sole heel portion, and a sole midfoot portion between the sole forefoot portion and the sole heel portion. The spool assembly may be coupled to the sole midfoot portion.

In one or more embodiments, the spool assembly may include a spool rotatable about an axis to wind and unwind the tension member. The spool assembly may further include an electric motor coupled to the spool. As such, the spool rotates about the axis upon activation of the electric motor. In one or more embodiments, a remote control may be in wireless communication with the electric motor to control an operation of the electric motor.

In one or more embodiments, the upper component may include a biasing member coupled to the second portion to bias the second portion toward the unfolded configuration.

In one or more embodiments, a sensor may be included to sense a wearer's foot inside the heel body. The sensor may be a pressure sensor coupled to the sole heel portion to sense a pressure exerted by a foot when the foot is inside the heel body.

In one or more embodiments, the heel body includes textile layers and a padding disposed in the textile layers to act as a heel counter and hold a foot when the second portion is in the folded configuration. The second portion may include a plurality of fold areas to allow the second portion to move between the unfolded configuration and the folded configuration. The second portion may include a plurality of panels. The fold areas may be disposed between the panels. The fold areas may be thinner than the panels.

In one or more embodiments, the second portion may include a plurality of fold areas to allow the second portion to move between the unfolded configuration and the folded configuration. The second portion may include panels. The fold areas may be disposed between the panels. The fold areas may be more flexible than the panels.

In one or more embodiments, the second portion may include a plurality of fold areas to allow the second portion to move between the unfolded configuration and the folded configuration. Each of the fold areas may have a substantially linear shape. The second portion may include a plurality of panels. The heel body may further include a plurality of elongated polymeric bodies coupled to the panels. Each of the elongated polymeric bodies may be disposed adjacent a respective one of the fold areas. Each of the elongated polymeric bodies is substantially parallel to the respective one of the fold areas.

The second portion may include a plurality of panels and a base layer. The panels are coupled to the base layer. The second portion further includes a filler disposed between the base layer and the panels. The base layer defines a plurality of fold areas between adjacent one of the panels.

The present disclosure also describes an article of footwear. In one or more embodiments, the article of footwear includes a sole structure and an upper coupled to the sole structure. The upper component includes a heel body. The heel body includes may include a first portion partially defining an ankle opening. The heel body further includes a second portion coupled to the first portion. The second portion is foldable and partially defines the ankle opening. The second portion is movable relative to the first portion between an unfolded configuration and a folded configuration. The heel body further includes at least one tension member coupled to the second portion. The tension member is movable relative to the first portion to move the second portion from the unfolded configuration to the folded configuration. The ankle opening is larger when the second portion is in the unfolded configuration than when the second portion is in the folded configuration to allow easy entry of the foot into the article of footwear.

In one or more embodiments, the upper component may further include a tube partly disposed inside the first portion. The tension member is disposed in the tube minimize friction between the at least one tension member and the heel body when the tension member moves relative to the first portion.

In one or more embodiments, the second portion may include a medial foldable side and a lateral foldable side. The tension member may include a first string segment coupled to the second portion at the foldable lateral side. The tension member may include a second string segment coupled to the second portion at the foldable medial side. The tension member may include a third string segment interconnecting the first string segment and the second string segment. The third string segment may be disposed outside the heel body to allow a wearer to manually pull the third string segment to move the second portion from the unfolded configuration to the folded configuration.

In one or more embodiments, the article of footwear may further include a spool assembly coupled to the sole structure. The spool assembly may be coupled to the tension member to move the second portion between the unfolded configuration and the folded configuration.

In one or more embodiments, the sole structure may include a sole forefoot portion, a sole heel portion, and a sole midfoot portion between the sole forefoot portion and the sole heel portion. The spool assembly may be coupled to the sole midfoot portion.

In one or more embodiments, the spool assembly may include a spool rotatable about an axis to wind and unwind the tension member. The spool assembly may further include an electric motor coupled to the spool such that the spool rotates about the axis upon activation of the electric motor. In one or more embodiments, a remote control may be in wireless communication with the electric motor to control an operation of the electric motor.

In one or more embodiments, the heel body may include a biasing member coupled to the second portion to bias the second portion toward the unfolded configuration.

In one or more embodiments, a sensor may be included to sense a wearer's foot inside the heel body. The sensor may be a pressure sensor coupled to the sole heel portion to sense a pressure exerted by a foot when the foot is inside the heel body.

In one or more embodiments, the heel body includes a textile layers. The textile layers may be partially stuffed with padding to act as a heel counter and hold a foot when the second portion is in the folded configuration. The second portion may include a plurality of fold areas to allow the second portion to move between the unfolded configuration and the folded configuration. The second portion may include a plurality of panels. The fold areas may be disposed between the panels. The fold areas may be thinner than the panels.

In one or more embodiments, the second portion may include a plurality of fold areas to allow the second portion to move between the unfolded configuration and the folded configuration. The second portion may include panels. The fold areas may be disposed between the panels. The fold areas may be more flexible than the panels.

In one or more embodiments, the second portion may include a plurality of fold areas to allow the second portion to move between the unfolded configuration and the folded configuration. Each of the fold areas may have a substantially linear shape. The second portion may include a plurality of panels. The heel body may further include a plurality of elongated polymeric bodies coupled to the panels. Each of the elongated polymeric bodies may be disposed adjacent a respective one of the fold areas. Each of the elongated polymeric bodies is substantially parallel to the respective one of the fold areas.

The second portion may include a plurality of panels and a base layer. The panels are coupled to the base layer. The second portion further includes a filler disposed between the base layer and the panels. The base layer defines a plurality of fold areas between adjacent one of the panels.

The above features and advantages and other features and advantages of the present teachings are readily apparent from the following detailed description of the best modes for carrying out the teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims. The invention illustratively disclosed herein may be practiced in the absence of any element which is not specifically disclosed herein.

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole structure). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed farther from the interior of the article or from the foot. Thus, for example, the inner surface of a component is disposed closer to an interior of the article than the outer surface of the component. This detailed description makes use of these directional adjectives in describing an article and various components of the article, including an upper component, a midsole structure and/or an outer sole structure.

Figure 2:
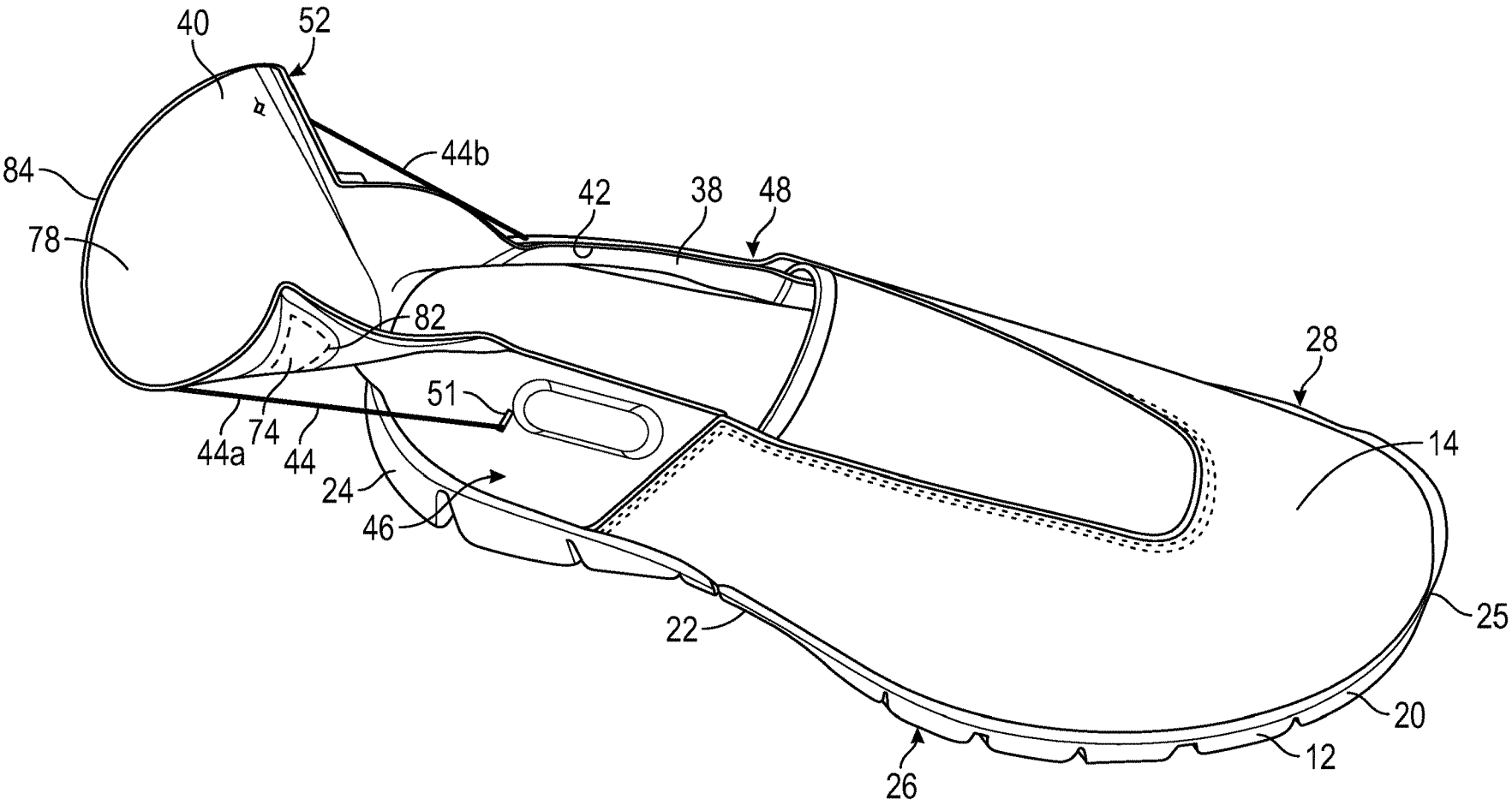
FIG. 2 is a schematic illustration in top view of the article of footwear of FIG. 1.
Figure 3:
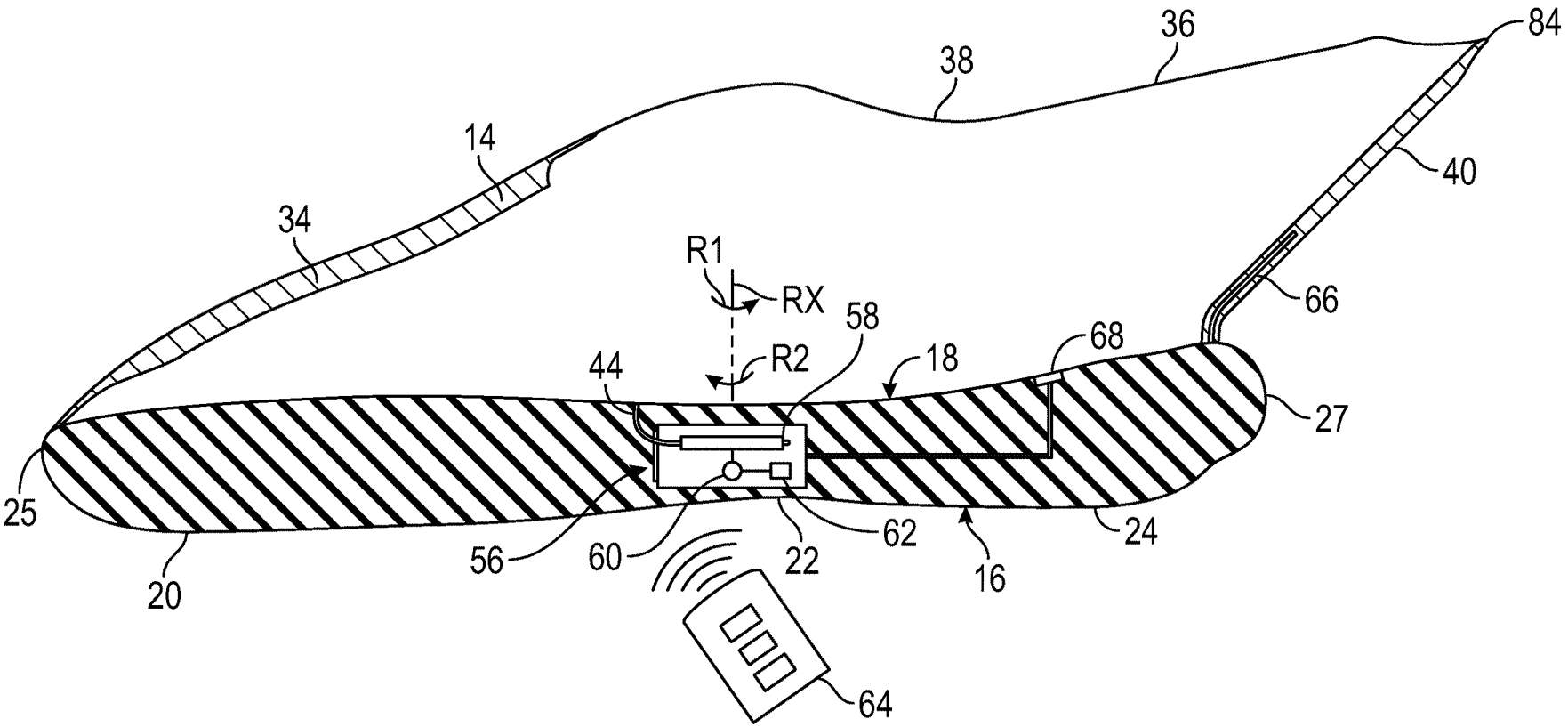
FIG. 3 is a schematic cross-sectional illustration of the article of footwear of FIG. 1, taken at lines 3-3 in FIG. 1.

Referring to the drawings, wherein like reference numbers correspond to like or similar components throughout the several figures, and beginning with FIGS. 1-3, shows an article of footwear 10 including a sole structure 12 and an upper component 14 coupled to the sole structure 12. As discussed in detail below, the upper component 14 allows easy entry of the foot into the article of footwear 10.

With continuing reference to FIGS. 1-3, the sole structure 12 provides traction, imparts stability, and limits various foot motions and defines a ground-facing surface 16 and a foot-facing surface 18 opposite the ground-facing surface 16. The foot-facing surface 18 of the sole structure 12 supports the foot directly or indirectly through an overlying insole layer. In an embodiment, the sole structure 12 may include traction elements. The traction elements protrude below the ground-facing surface 16. In one or more embodiments, the traction elements could include cleats or spikes.

The sole structure 12 may be divided into the sole forefoot portion 20, the sole midfoot portion 22, and the sole heel portion 24. The sole midfoot portion 22 is between the sole heel portion 24 and the sole forefoot portion 20. The sole forefoot portion 20 may be generally associated with the toes and joints connecting the metatarsals with the phalanges. The sole midfoot portion 22 may be generally associated with the arch of a foot. The sole heel portion 24 may be generally associated with the heel of a foot, including the calcaneus bone. In addition, the sole structure 12 may include a sole lateral side 26 and a sole medial side 28. In particular, the sole lateral side 26 and the sole medial side 28 may be opposing sides of the sole structure 12. Furthermore, both the sole lateral side 26 and the sole medial side 28 may extend through the sole forefoot portion 20, the sole midfoot portion 22, and the sole heel portion 24. As used herein, a lateral side of a component for the article of footwear 10, including the sole lateral side 26, is a side that corresponds with an outside area of the human foot (i.e., the side closer to the fifth toe of the wearer). The fifth toe is commonly referred to as the little toe. A medial side of a component for an article of footwear 10, including the sole medial side 28, is the side that corresponds with an inside area of the human foot (i.e., the side closer to the hallux of the foot of the wearer). The hallux is commonly referred to as the big toe. Both the sole lateral side 26 and the sole medial side 28 extend from a foremost extent 25 to a rearmost extent 27 of a periphery of the sole structure 12.

As discussed above, the sole structure 12 is coupled to the upper component 14. The upper component 14 may have any design, shape, size and/or color. For example, in embodiments where the article of footwear 10 is a basketball shoe, the upper component 14 could be a high top upper component that is shaped to provide high support on an ankle. In embodiments where article of footwear 10 is a running shoe or golf shoe, the upper component 14 could be a low top upper component. The upper component 14 defines an ankle opening 42 that provides entry for the foot into an interior cavity of upper component 14. In some embodiments, the upper component 14 may also include a tongue 30 that provides cushioning and support across the instep of the foot. Some embodiments may include fastening provisions, including, but not limited to: laces, cables, straps, buttons, zippers as well as any other provisions known in the art for fastening articles. Some embodiments may include uppers components 14 that extend beneath the foot, thereby providing three hundred sixty degrees coverage at some regions of the foot. However, other embodiments need not include uppers components 14 that extend beneath the foot. In other embodiments, for example, the upper component 14 could have a lower periphery joined with a sole structure and/or a strobel or sock liner.

The longitudinal direction of the sole structure 12 extends along a length of the sole structure 12, e.g., from the sole forefoot portion 20 to the sole heel portion 24 of the sole structure 12. The term "forward" is used to refer to the general direction from the sole heel portion 24 toward the sole forefoot portion 20, and the term "rearward" is used to refer to the opposite direction, i.e., the direction from the sole forefoot portion 20 toward the sole heel portion 24.

The upper component 14 includes a main upper body 34 and a heel body 36 coupled to the main upper body 34. The main upper body 34 may be coupled to and disposed over the sole forefoot portion 20 and the sole midfoot portion 22, whereas the heel body 36 is coupled to and disposed over the sole heel portion 24. As a non-limiting example, stitching may be used to couple the main upper body 34 to the heel body 36. The main upper body 34 may include a first upper material. In other words, the main upper body 34 may be wholly or partly made of the first upper material. The first upper material may be a fused polymeric material with limited (or virtually no) elasticity. The heel body 36 may include a second upper material. In other words, the heel body 36 may be wholly or partly made of a second upper material. The second upper material may be a polymeric material capable of providing elasticity to the upper component 14. As non-limiting examples, the second upper material may be of braided construction, a knitted (e.g., warp-knitted) construction or a woven construction. Regardless of the specific material employed, the first upper material may have a first elastic modulus, and the second upper material may have a second elastic modulus, which may be less than the first elastic modulus.

Figure 7:
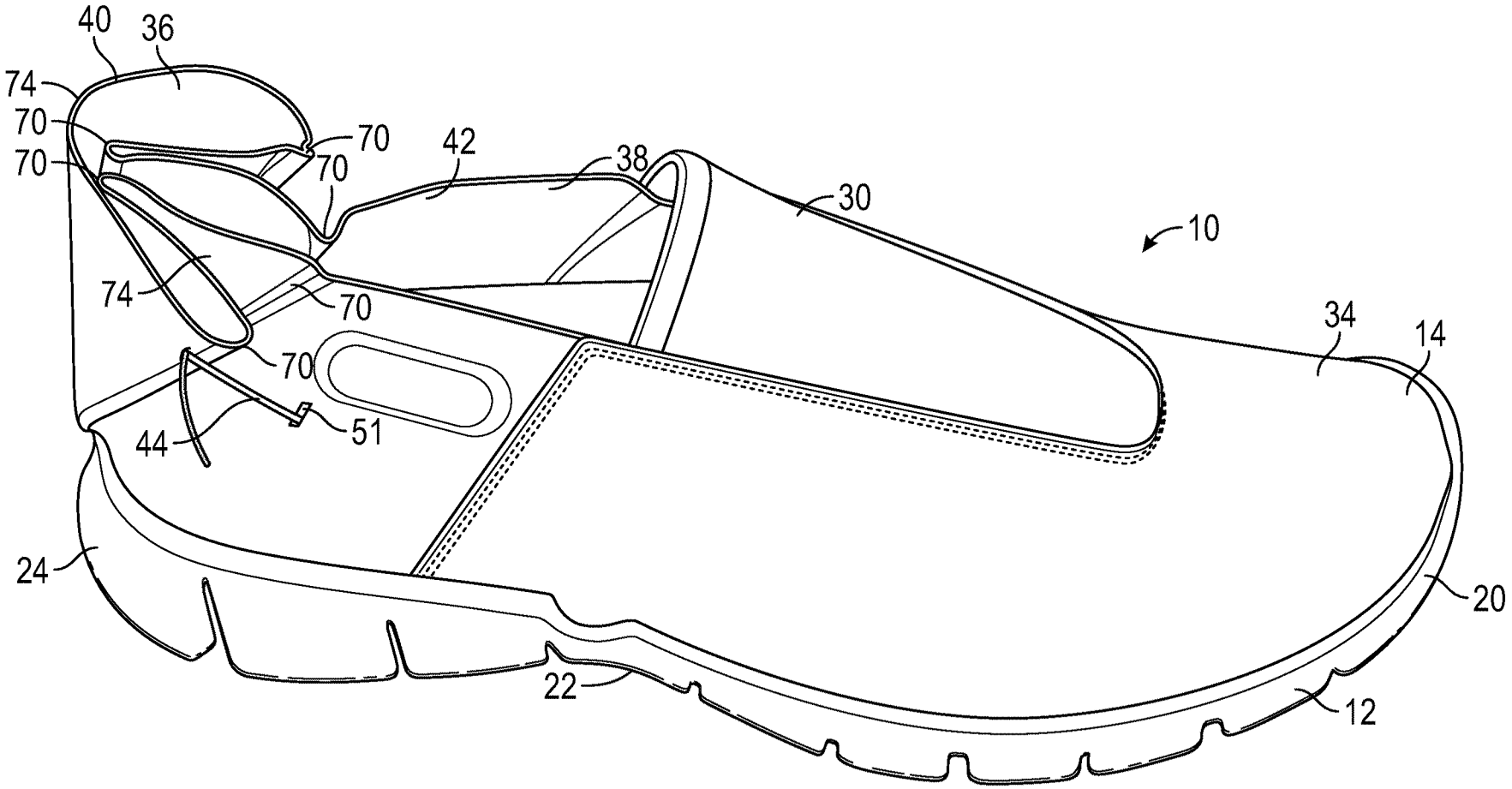
FIG. 7 is a schematic illustration in perspective view of the article of footwear of FIG. 1, showing the second portion of the upper component in a fully folded configuration.

The heel body 36 includes a first portion 38 and a second portion 40 coupled to the first portion. The second portion 40 is foldable and movable relative to the first portion 38 between an unfolded configuration (FIG. 1) and a folded configuration (FIG. 7). The first portion 38 is not necessarily entirely stationary, but rather it may flex when subjected to forces. The first portion 38 and the second portion 40 collectively define an entirety of the ankle opening 42. The article of footwear 10 further includes at least one tension member 44 coupled (anchored) to the second portion 40. In the present disclosure, the term "tension member" means a structural element that is subjected to an axial tensile force. As a non-limiting example, the tension member 44 may be flexible structural element, such as a cable or string. The tension member 44 is movable relative to the first portion 38 to move (e.g., pull) the second portion 40 from the unfolded configuration to the folded configuration. Therefore, the first portion 38 does not necessarily move when the tension member 44 is subjected to axial tensile forces. Further, the first portion 38 does not fold when the tension member is subjected to axial tensile forces. In contrast, the second portion 40 is specifically configured (i.e., constructed and designed) to fold upon itself when the tension member 44 is subjected to axial tension forces. The ankle opening 42 is larger when the second portion 40 is in the unfolded configuration (FIG. 1) than when the second portion 40 is in the folded configuration (FIG. 7) to allow easy entry of the foot into the article of footwear.

The article of footwear 10 may include one or more tubes 45 at least partially disposed inside the heel body 36 to minimize the friction between the tension member 44 and the heel body 36 when the tension member 44 moves relative to the upper component 14. To minimize this friction, the tube 45 may be made of a polymeric material with an anti-friction coating on its inner surface. In the depicted embodiment, the article of footwear 10 includes two tubes 45. One tube 45 is disposed on an upper lateral side 46, and another tube 45 is disposed on the upper medial side 48. Further, in the depicted embodiment, the tubes 45 are partially disposed inside the heel body 36 and the main upper body 34. The heel body 36 may include one or more tension member opening 51 to receive the tension member 44. The tension member opening 51 leads to at least one of the tubes 45. The tube 45 partly receives the tension member 44 to minimize friction between the tension member 44 and the upper component 14 (including the heel body 36) when the tension member 44 moves relative to the first portion 38. In other words, the tension member 44 is disposed in the tube 45.

Figure 8:
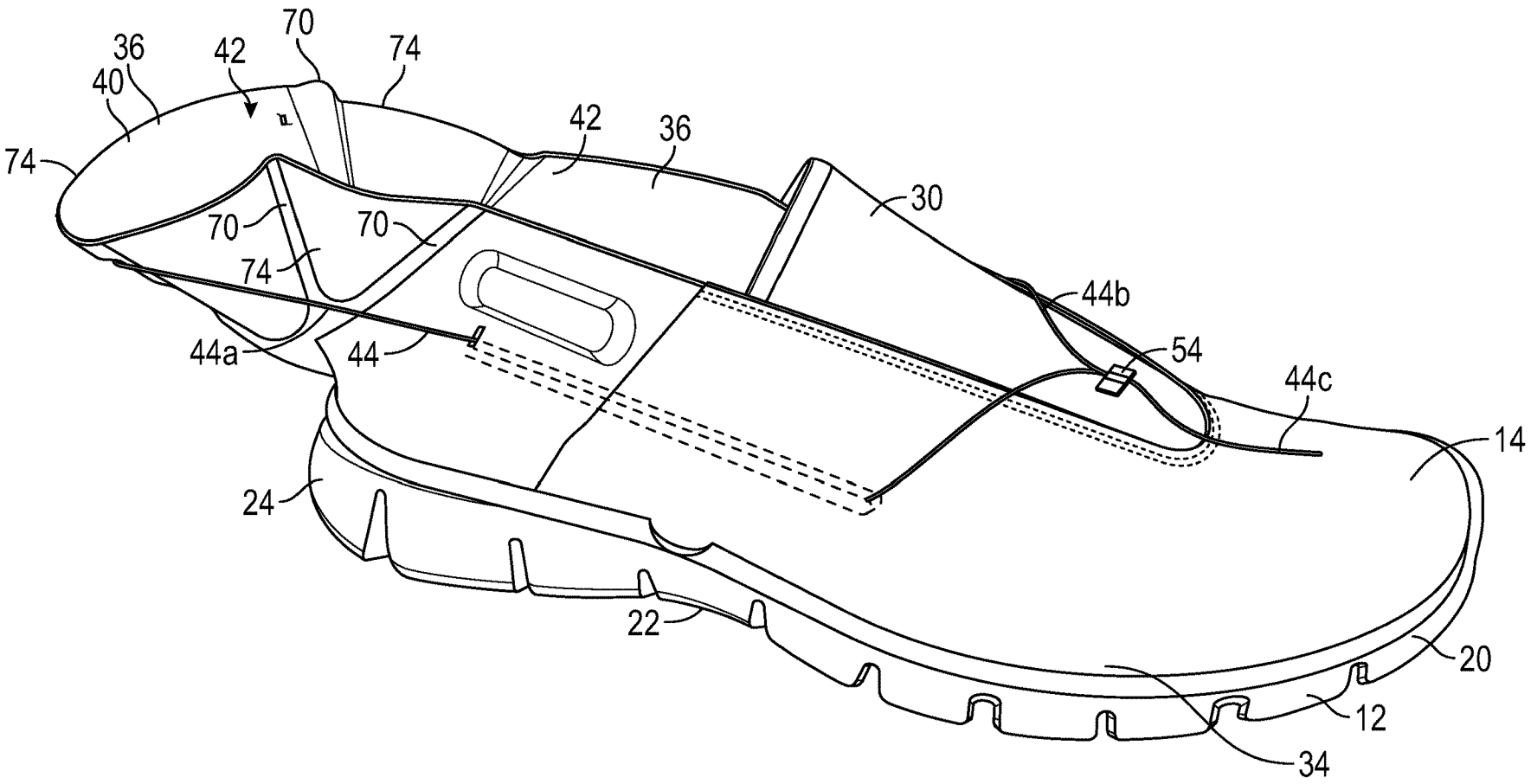
FIG. 8 is a schematic illustration in perspective view of the article of footwear according to another aspect of the present disclosure.

The second portion 40 includes a foldable lateral side 50 and a foldable medial side 52. In the depicted embodiment, the tension member 44 includes a first string segment 44*a* and a second string segment 44*b*. The first string segment 44*a* is coupled (anchored) to the second portion 40 at the foldable lateral side 50, and the second string segment 44*b* coupled (anchored) to the second portion 40 at the foldable medial side 52. In the embodiment depicted in FIG. 8, the tension member 44 includes a third string segment 44*c* interconnecting the first string segment 44*a* and the second string segment 44*b*. The third string segment 44*c* is disposed outside the heel body 36 (and the upper component 14 as a whole) to allow a wearer to manually pull a single string segment (i.e., the third string segment 44*c*) to move the second portion 40 from the unfolded configuration to the folded configuration. In this embodiment, the article of footwear 10 may further include a lock 54 to lock the tension member 44 once the heel body 36 is in the folded configuration. As a non-limiting embodiment, the lock 54 may be a polymeric cord lock or any other lock suitable to attach and tighten the tension member 44 without the use of knots. Further, in one or more embodiments, pulling a single string segment (i.e., the third string segment 44*c*) may cause cinching on both the lateral and medial side of the article of footwear 10 and may provide lockdown and support of the wearer's foot within the article of footwear 10. This single string segment (i.e., the third string segment 44*c*) may be part of a lacing system that may provide lockdown and support of the wearer's foot within the article of footwear 10.

With specific reference to FIG. 3, the article of footwear 10 may further include a spool assembly 56 for winding or unwinding the tension member 44 to move second portion 40 between the unfolded configuration (FIG. 7). Thus, the spool assembly 56 is coupled to the tension member 44. In the depicted embodiment, the spool assembly 56 is coupled to the sole structure 12. Specifically, the spool assembly 56 may be coupled to the sole midfoot portion 22 of the sole structure 12. For instance, the spool assembly 56 may be wholly or partly embedded inside the sole midfoot portion 22 or it may be positioned under the sole midfoot portion 22. The spool assembly 56 includes a spool 58 rotatable about an axis RX to wind and unwind the tension member 44. In addition, the spool assembly 56 includes an electric motor 60 coupled to the spool 58. Upon activation of the electric motor 60, the spool 58 rotates about the axis RX in either a first rotational direction R1 or a second rotational direction R2 about the axis RX. The spool assembly 56 may further include an energy storage device 62 electrically connected to the electric motor 60. The energy storage device 62 is capable of storing electrical energy. As a non-limiting example, the energy storage device 62 may be replaceable battery or battery pack or a rechargeable battery or battery pack.

The spool assembly 56 further includes a remote control 64 in wireless communication with the electric motor 60. The term "wireless" refers to communications, monitoring, or control system in which electromagnetic or acoustic waves carry a signal through atmospheric space rather than along an electrically conductive structural object, such a wire or any other physical metal contact. Thus, the remote control 64 is in wireless communication with the electric motor 60 to control an operation of the electric motor 60.

With reference again to FIGS. 1-3, the heel body 36 further includes a biasing member 66 coupled to the second portion 40 to bias the second portion 40 toward the unfolded configuration (FIG. 1). The biasing member 66 is disposed within the second portion 40 and may be a resilient polymer object, such as foam elongated objected, anchored to the sole heel portion 24 and extending toward the rearmost foldable extent 84 of the second portion 40. During operation, once the electric motor 60 allows slack in the tension member 44, the biasing member 66 can bias the second portion 40 toward the unfolded position (FIG. 1).

Aside from the biasing member 66, the article of footwear 10 may further include a sensor 68 to sense a wearer's foot inside the heel body 36. The sensor 68 is in communication (e.g., electronic communication) with the electric motor 60. As such, when the sensor 68 senses the wearer's foot inside the heel body 36, the sensor 68 sends a signal to the electric motor 60. In response to this signal, the electric motor 60 activates to wind the tension member 44 around the spool 58, thereby moving the second portion 40 from the unfolded position to the folded position. As a non-limiting example, the sensor 68 is a pressure sensor coupled to the sole heel portion 24 to sense a pressure exerted by a foot on the sole structure 12 when the foot is inside the heel body 36.

Figure 4:
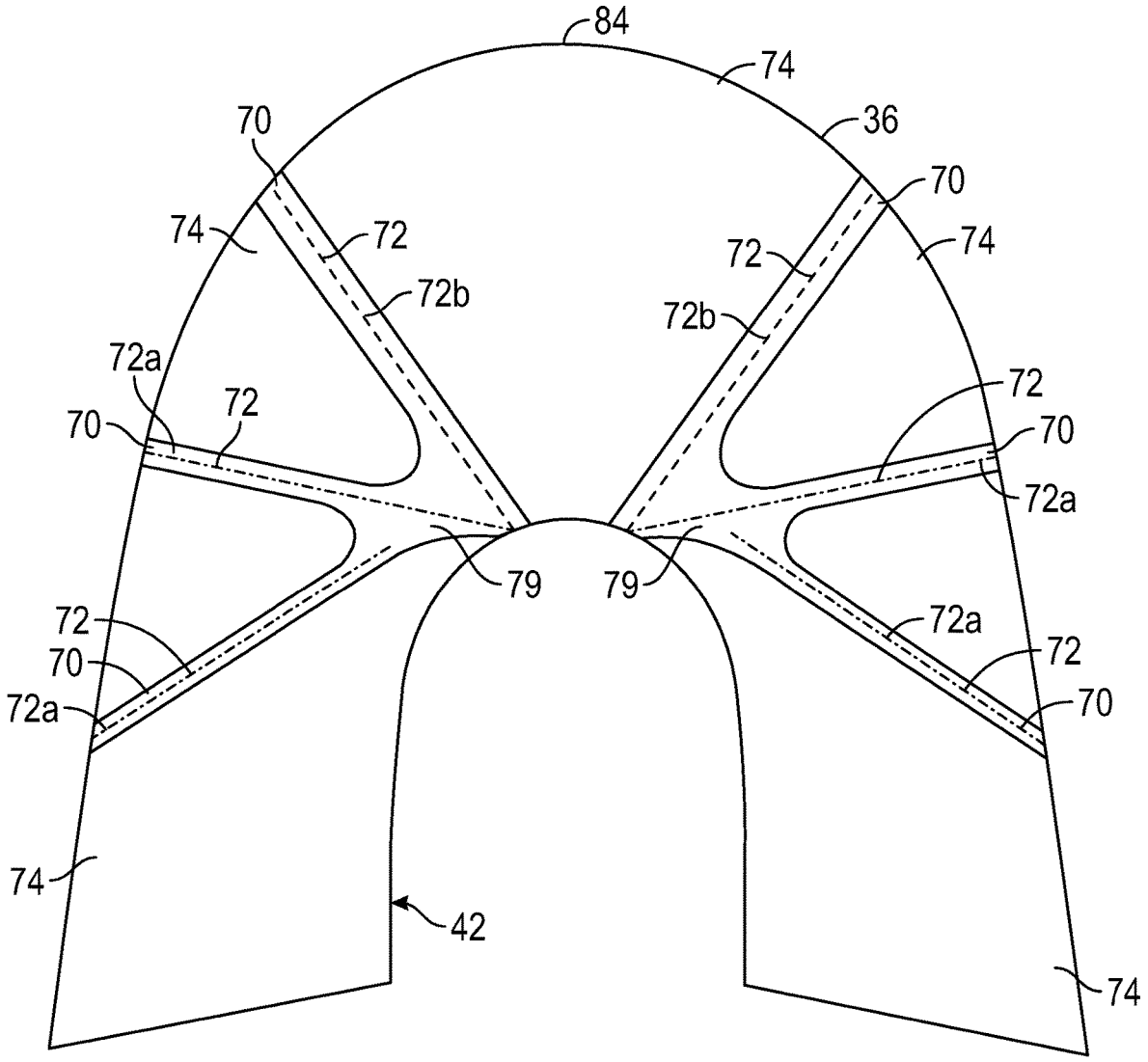
FIG. 4 is a schematic illustration in top view of a heel body of the article of footwear of FIG. 1.

With reference to FIG. 4, the heel body 36 includes a textile layers. In other words, the heel body 36 is wholly or partly made of a textile layers. As a non-limiting example, the textile layers may be wholly or partly made of synthetic olefin fibers. The textile layers are partially stuffed with padding 82 (e.g., filler—shown in FIG. 2) to act as a heel counter and hold a foot when the second portion 40 is in the folded configuration. In other words, the padding 82 is disposed in the textile layers to act as a heel counter and hold a foot when the second portion 40 is in the folded configuration.

The second portion 40 includes a plurality of fold areas 70 to allow the second portion 40 to move between the unfolded configuration (FIG. 1) and the folded configuration (FIG. 7). Each of the fold areas 70 may define predetermined crease lines 72. Specifically, the fold areas 70 define pre-formed crease lines 72*a* that allow some fold areas 70 to fold inwardly toward the ankle opening 42 and pre-formed crease lines 72*b* that allow other fold areas 70 to fold outwardly away from the ankle opening 42. In the second portion 40, the fold areas 70 are disposed between panels 74. The fold areas 70 may be thinner than the panels 74 to help with the repeatability of the folds in the second portion 40. Moreover, the fold areas 70 may be more flexible than the panels 74 to help with the repeatability of the folds in the second portion 40. To do so, the panels 74 may be stiffened in comparison with the fold areas 70. As a non-limiting example, the panels 74 (which are not designed to be folded) can be coated with a material that is stiffer in comparison with the material forming the fold areas 70.

With reference again to FIG. 1, the fold areas 70 of the heel body 36 may have a substantially linear shape to help with the repeatability of the folds in the second portion 40. The heel body 36 further includes a plurality of elongated polymeric bodies 76 coupled to the panels 74 to promote repeatability of the folding near and parallel to the fold areas 70. Each of the elongated polymeric bodies 76 is disposed adjacent a respective one of the fold areas 70 and is substantially parallel to the respective one of the fold areas 70 to help with the repeatability of the folds in the second portion 40. The elongated polymeric bodies 76 may wholly or partly of a material that is more rigid than the material forming the fold areas 70 to facilitate folding the second portion 40.

With reference to FIG. 2, the second portion 40 includes a base layer 78. The baser layer 78 may be a liner. Further, the base layer 78 may also extend along the first portion 38 of the heel body 36. The panels 74 are coupled to the base layer 78. Portions of the base layers 78 that are not covered by the panels 74 become a webbing 79. The second portion 40 includes may include a filler (e.g., foam) disposed between the base layer 78 and the panels 74 to inhibit the panels 74 from folding. The base layer 78 defines the fold areas 70 between adjacent panels 74 to allow the second portion 40 to move between the unfolded configuration and the folded configuration.

Figure 5:
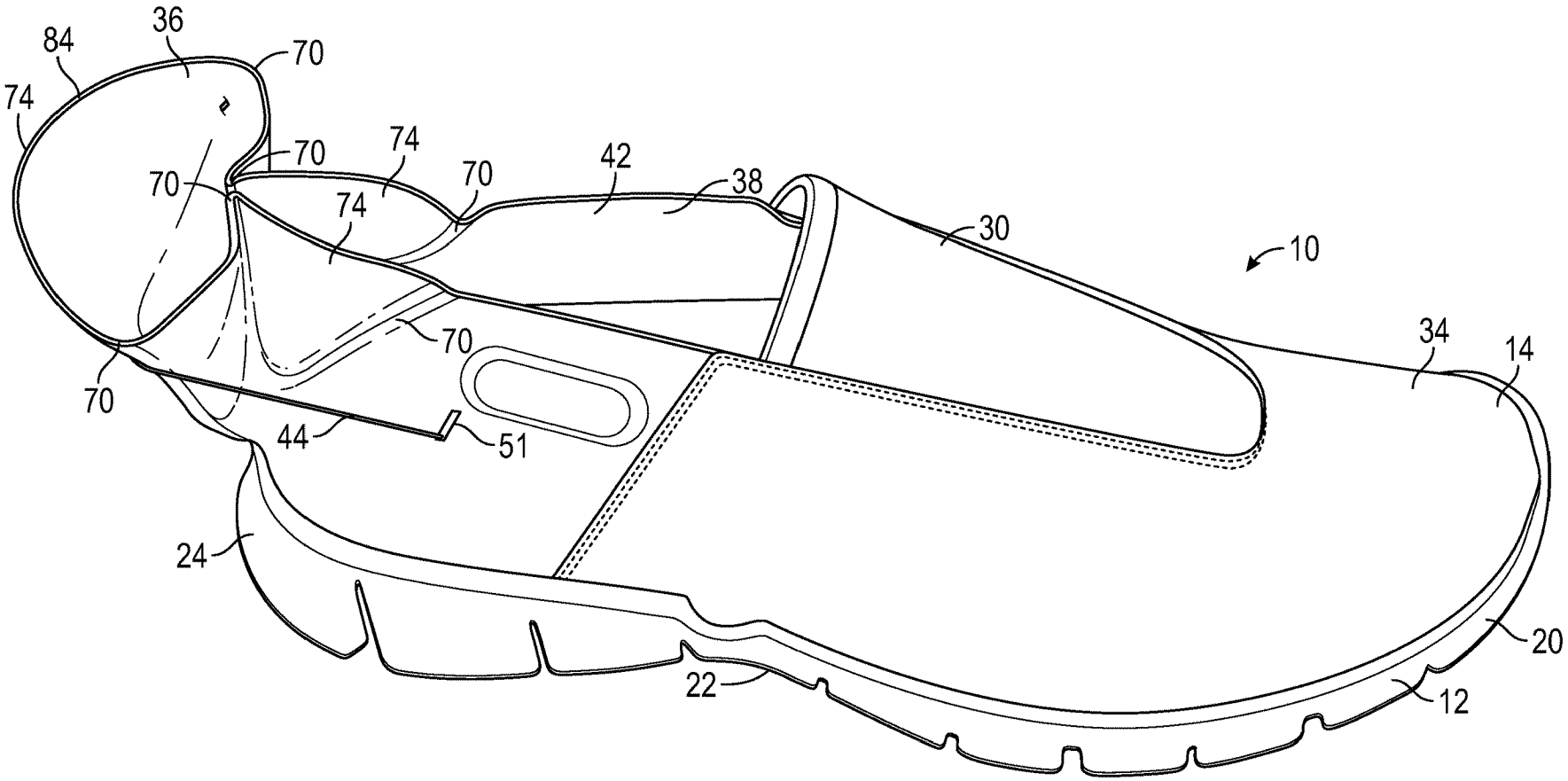
FIG. 5 is a schematic illustration in perspective view of the article of footwear of FIG. 1, showing the second portion of the upper component in a first partially folded configuration.
Figure 6:
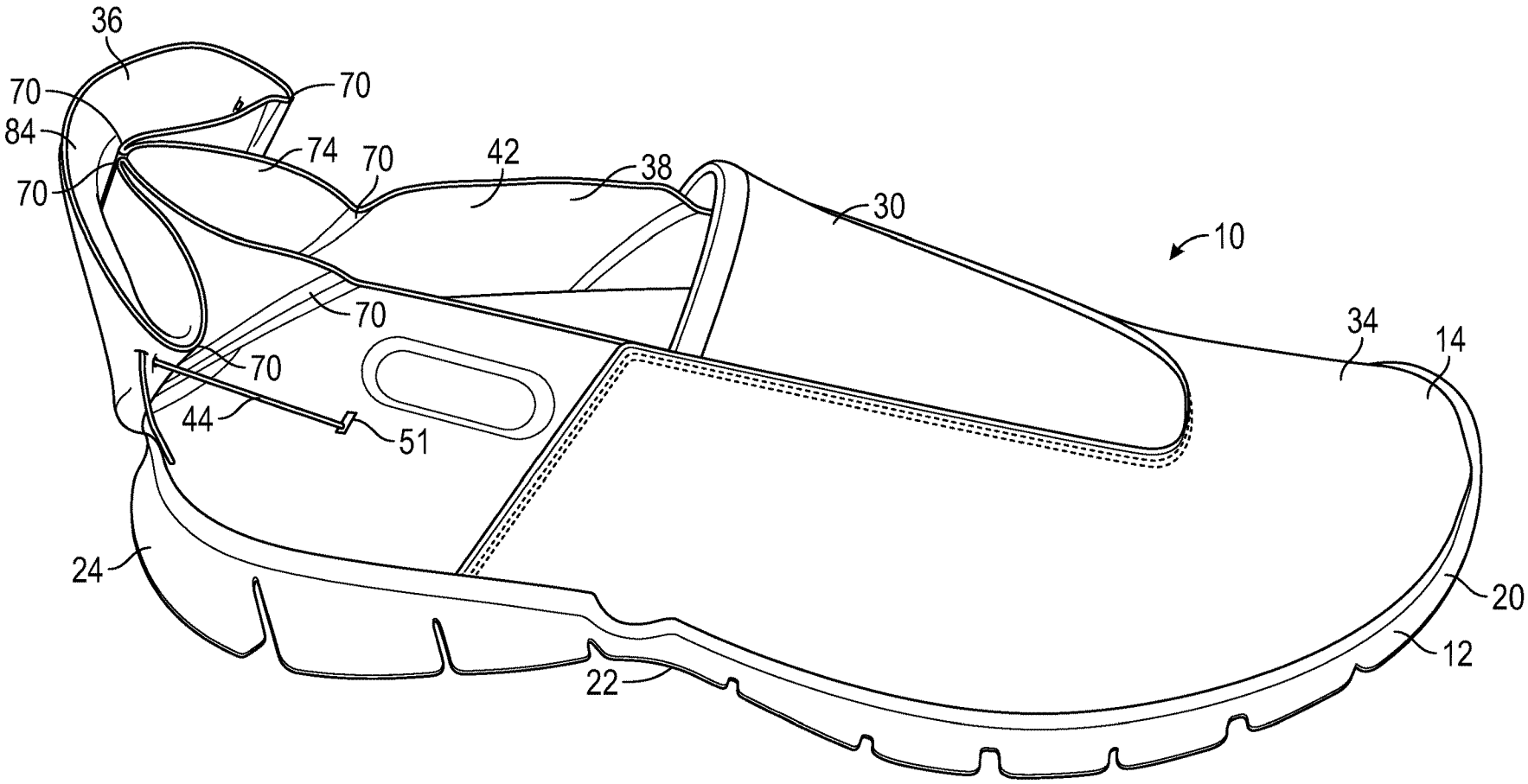
FIG. 6 is a schematic illustration in perspective view of the article of footwear of FIG. 1, showing the second portion of the upper component in a second partially folded configuration.

With reference to FIGS. 1-7, the heel body 36 eases the insertion of a foot inside the article of footwear 10. Initially, the second portion 40 should be in the unfolded configuration as shown in FIGS. 1 and 2. In the unfolded configuration, the ankle opening 42 may have its maximum perimeter, thereby facilitating insertion of a foot inside the article of footwear 10. At the very least, perimeter of the ankle opening 42 is larger when the second portion 40 is in its unfolded configuration than when it is its folded configuration (FIG. 7). Once the wearer's foot is inside the article of footwear 10, the wearer may activate the electric motor 60 throughout the remote control 64 to wind the tension member 44 around the spool 58 and therefore apply tension to the tension member 44. Alternatively, the sensor 68 may sense the presence of the wearer's foot in the article of footwear 10 and, in response, the electric motor 60 is activated to wind the tension member 44 around the spool 58. Alternatively, in the embodiment shown in FIG. 8, the wearer may manually apply a tensile force to the tension member 44 through the third string segment 44*c*. As tension is applied to the tension member 44, the second portion 40 moves relative to the first portion 38. For example, some fold areas 70 fold inwardly toward the ankle opening 42 along the preformed crease lines 72*a* as shown in FIG. 5. At this point, other fold areas 70 may also fold outwardly (away from the ankle opening 42) while the rearmost foldable extent 84 of the second portion 40 moves forward as shown in FIG. 5. Continued application of tensile forces to the tension member 44 causes the rearmost foldable extent 84 of the second portion 40 to move further forward as shown in FIG. 6. As a consequence, some of the panels 74 are partially folded over each other along the fold areas 70 as shown in FIG. 6. Further application of tensile forces to the tension member 44 causes the panels 74 to be fully folded over the each other along the fold areas 70, as shown in FIG. 7, to tighten the heel body 36 around the wearer's ankle.

To remove the foot from the article of footwear 10, the wearer may simply activate the electric motor 60 to unwind the tension member 44 from the spool 58. Once the electric motor 60 allows slack in the tension member 44, the biasing member 66 can bias the second portion 40 toward the unfolded position (FIG. 1). Alternatively, the wearer may unlock the lock 54 to allow slack in the tension member 44 and, thereafter, the biasing member 66 can bias the second portion 40 toward the unfolded position (FIG. 1).

While the best modes for carrying out the teachings have been described in detail, those familiar with the art to which this disclosure relates will recognize various alternative designs and embodiments for practicing the teachings within the scope of the appended claims. The article of footwear 10 and upper component 14 illustratively disclosed herein may be suitably practiced in the absence of any element which is not specifically disclosed herein. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings.

What is claimed is:

1. An upper component for an article of footwear, comprising:

a heel body including:

an anterior body portion partially defining an ankle opening;

a posterior body portion coupled to the anterior body portion, wherein the posterior body portion is foldable and partially defines the ankle opening, and the posterior body portion is movable relative to the anterior body portion between an unfolded configuration and a folded configuration;

at least one tension member anchored at the posterior body portion, wherein the at least one tension member is movable relative to the anterior body portion to move the posterior body portion from the unfolded configuration to the folded configuration; and wherein the ankle opening is larger when the posterior body portion is in the unfolded configuration than when the posterior body portion is in the folded configuration.

2. The upper component of claim 1, wherein the at least one tension member includes an anterior member portion and a posterior member portion coupled to the anterior member portion, and the posterior member portion of the at least one tension member is engaged with the posterior body portion of the heel body.

3. The upper component of claim 1, wherein the at least one tension member includes a first member end and a second member end opposite the first member end, and the first member end is anchored to the posterior body portion of the upper component.

4. The upper component of claim 1, wherein the at least one tension member includes a first tension member and a second tension member, and each of the first tension member and the second tension member is anchored at the posterior body portion of the heel body.

5. The upper component of claim 1, wherein the at least one tension member includes a first tension member and a second tension member, each of the first tension member and the second tension member includes an anterior member portion and a posterior member portion, and the posterior member portion of each of the first tension member and the second tension member is anchored at a back of the heel body.

6. The upper component of claim 1, further comprising a tube partly disposed inside the anterior body portion, wherein:

the at least one tension member is disposed in the tube to minimize friction between the at least one tension member and the heel body when the tension member moves relative to the posterior body portion.

7. The upper component of claim 1, wherein:

the posterior body portion includes a medial foldable side and a lateral foldable side;

the at least one tension member includes a first string segment coupled to the posterior body portion at the lateral foldable side;

the at least one tension member includes a second string segment coupled to the posterior body portion at the medial foldable side;

the at least one tension member includes a third string segment interconnecting the first string segment and the second string segment; and the third string segment is disposed outside the heel body to allow a wearer to manually pull the third string segment to move the posterior body portion from the unfolded configuration to the folded configuration.

8. The upper component of claim 1 in combination with a sole structure, further comprising a spool assembly coupled to the sole structure, wherein:

the spool assembly is coupled to the at least one tension member to move the posterior body portion between the unfolded configuration and the folded configuration.

9. The upper component of claim 8, wherein:

the sole structure includes a sole forefoot portion, a sole heel portion, and a sole midfoot portion between the sole forefoot portion and the sole heel portion; and the spool assembly is coupled to the sole midfoot portion.

10. The upper component of claim 9, wherein the spool assembly further includes:

a spool rotatable about an axis to wind and unwind the at least one tension member; and an electric motor coupled to the spool such that the spool rotates about the axis upon activation of the electric motor.

11. The upper component of claim 10, further comprising a remote control in wireless communication with the electric motor to control an operation of the electric motor.

12. The upper component of claim 1, further comprising a sensor to sense a wearer's foot inside the heel body.

13. The upper component of claim 12 in combination with a sole structure, wherein:

the sole structure includes a sole forefoot portion, a sole heel portion, and a sole midfoot portion between the sole forefoot portion and the sole heel portion; and the sensor is a pressure sensor coupled to the sole heel portion to sense a pressure exerted by a foot when the foot is inside the heel body.

14. The upper component of claim 1, wherein:

the posterior body portion includes a plurality of fold areas;

the posterior body portion includes a plurality of panels;

the fold areas are thinner than the panels; and the posterior body is foldable along the fold areas.

15. The upper component of claim 1, wherein:

the posterior body portion includes a plurality of fold areas to allow the posterior body portion to move between the unfolded configuration and the folded configuration;

each of the fold areas has a substantially linear shape;

the posterior body portion includes a plurality of panels;

the heel body further includes a plurality of elongated polymeric bodies coupled to the panels;

each of the elongated polymeric bodies is disposed adjacent a respective one of the fold areas; and each of the elongated polymeric bodies is substantially parallel to the respective one of the fold areas.

16. An article of footwear, comprising:

a sole structure;

an upper component coupled to the sole structure, wherein the upper component includes a heel body, and the heel body includes:

a first portion partially defining an ankle opening;

a second portion coupled to the first portion, wherein the second portion is foldable and partially defines the ankle opening, the second portion is movable relative to the first portion between an unfolded configuration and a folded configuration, the second portion includes a plurality of fold areas to allow the second portion to move between the unfolded configuration and the folded configuration, and the second portion includes a plurality of panels;

at least one tension member coupled to the second portion, wherein the at least one tension member is movable relative to the first portion to move the second portion from the unfolded configuration to the folded configuration;

wherein the at one least tension member is anchored at the second portion of the upper component; and wherein the ankle opening is larger when the second portion is in the unfolded configuration than when the second portion is in the folded configuration.

17. The article of footwear of claim 16, wherein the at least one tension member includes a first tension member and a second tension member, each of the first tension member and the second tension member includes an anterior member portion and a posterior member portion, the second portion defines a back of the heel body, and the posterior member portion of each of the first tension member and the second tension member is engaged with the back of the heel body.

18. The article of footwear of claim 17, wherein the posterior member portion of each of the first tension member and the second tension member is anchored at the back of the heel body.

19. The article of footwear of claim 18, wherein:

the second portion includes a medial foldable side and a lateral foldable side;

the at least one tension member includes a first string segment coupled to the second portion at the lateral foldable side;

the at least one tension member includes a second string segment coupled to the second portion at the medial foldable side;

the at least one tension member includes a third string segment interconnecting the first string segment and the second string segment; and the third string segment is disposed outside the heel body to allow a wearer to manually pull the third string segment to move the second portion from the unfolded configuration to the folded configuration.

20. The article of footwear of claim 18, further comprising a spool assembly coupled to the sole structure, wherein:

the spool assembly is coupled to the at least one tension member to move the second portion between the unfolded configuration and the folded configuration;

the sole structure includes a sole forefoot portion, a sole heel portion, and a sole midfoot portion between the sole forefoot portion and the sole heel portion;

the spool assembly is coupled to the sole midfoot portion;

the spool assembly further includes:

a spool rotatable about an axis to wind and unwind the at least one tension member; and an electric motor coupled to the spool such that the spool rotates about the axis upon activation of the electric motor.

* * * * *